US006311381B1

(12) United States Patent
Wendelgast, Jr.

(10) Patent No.: US 6,311,381 B1
(45) Date of Patent: Nov. 6, 2001

(54) ALTERNATOR BEARING DEPTH SETTING TOOL

(76) Inventor: William Wendelgast, Jr., 1957 Edgewood Dr., Charlestown, IN (US) 47111

( * ) Notice: Subject to any disclaimer, the term of this patent is extended or adjusted under 35 U.S.C. 154(b) by 0 days.

(21) Appl. No.: 09/388,954

(22) Filed: Sep. 2, 1999

(51) Int. Cl.[7] ..... B25B 27/14
(52) U.S. Cl. ..... 29/275
(58) Field of Search ..... 29/254, 255, 275, 29/280, 282, 263; 81/49

(56) References Cited

U.S. PATENT DOCUMENTS 1,956,634 * 5/1934 Watson ..... 29/275
3,266,134 * 8/1966 Moskovitz ..... 29/282
4,074,411 * 2/1978 Willard et al. ..... 26/282
4,903,882 * 2/1990 Long ..... 29/275
5,001,822 * 3/1991 Upthegrove ..... 29/275
5,544,552 * 8/1996 Kirsch et al. ..... 81/44
5,991,996 * 11/1999 Leverette ..... 29/275

* cited by examiner

*Primary Examiner*—Robert C. Watson
(74) *Attorney, Agent, or Firm*—Carrithers Law Office; David W. Carrithers

(57) ABSTRACT

A alternator bearing depth setting tool for unbinding a bearing in a rebuilt alternator so that the bearing will spin freely in the alternator. The alternator bearing depth setting tool includes an elongate body having opposite proximal and distal ends. The proximal end of the body has an inner well therein with an annular shoulder therearound adjacent the proximal end of the body to define an annular outer well.

9 Claims, 2 Drawing Sheets

ALTERNATOR BEARING DEPTH SETTING TOOL

BACKGROUND OF THE INVENTION

1. Field of the Invention

The present invention relates to devices for unbinding bearings in rebuilt alternators and more particularly pertains to a new alternator bearing depth setting tool for unbinding a bearing in a rebuilt alternator so that the bearing will spin freely in the alternator.

2. Description of the Prior Art

Presently, to unbind a bearing of a rebuilt alternator, a user is require to tap or hit the outer housing of the rebuilt alternator with a ball hammer until the bearing is jarred to a position at which it is able to spin freely in the outer housing of the rebuilt alternator. This method takes a significant amount of time and patience by the user and is requires lots of skill and practice to properly unbind the bearing.

Known prior art includes U.S. Pat. Nos. 2,441,981; 5,174,006; 3,651,553; 3,942,234; 2,775,025; and U.S. Patent. No. Des. 331,886 which are all incorporated herein to the extent necessary to understand the present invention and use thereof.

While these devices fulfill their respective, particular objectives and requirements, the aforementioned patents do not disclose a new alternator bearing depth setting tool. The inventive device includes an elongate body having opposite proximal and distal ends. The proximal end of the body has an inner well therein with an annular shoulder therearound adjacent the proximal end of the body to define an annular outer well.

In these respects, the alternator bearing depth setting tool according to the present invention substantially departs from the conventional concepts and designs of the prior art, and in so doing provides an apparatus primarily developed for the purpose of unbinding a bearing in a rebuilt alternator so that the bearing will spin freely in the alternator.

SUMMARY OF THE INVENTION

In view of the foregoing disadvantages inherent in the known types of devices for unbinding bearings in rebuilt alternators now present in the prior art, the present invention provides a new alternator bearing depth setting tool construction wherein the same can be utilized for unbinding a bearing in a rebuilt alternator so that the bearing will spin freely in the alternator.

The general purpose of the present invention, which will be described subsequently in greater detail, is to provide a new alternator bearing depth setting tool apparatus and method which has many of the advantages of the devices for unbinding bearings in rebuilt alternators mentioned heretofore and many novel features that result in a new alternator bearing depth setting tool which is not anticipated, rendered obvious, suggested, or even implied by any of the prior art devices for unbinding bearings in rebuilt alternators, either alone or in any combination thereof.

To attain this, the present invention generally comprises an elongate body having opposite proximal and distal ends. The proximal end of the body has an inner well therein with an annular shoulder therearound adjacent the proximal end of the body to define an annular outer well.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new alternator bearing depth setting tool apparatus and method which has many of the advantages of the devices for unbinding bearings in rebuilt alternators mentioned heretofore and many novel features that result in a new alternator bearing depth setting tool which is not anticipated, rendered obvious, suggested, or even implied by any of the prior art devices for unbinding bearings in rebuilt alternators, either alone or in any combination thereof.

It is another object of the present invention to provide a new alternator bearing depth setting tool which may be easily and efficiently manufactured and marketed.

It is a further object of the present invention to provide a new alternator bearing depth setting tool which is of a durable and reliable construction.

An even further object of the present invention is to provide a new alternator bearing depth setting tool which is susceptible of a low cost of manufacture with regard to both materials and labor, and which accordingly is then susceptible of low prices of sale to the consuming public, thereby making such alternator bearing depth setting tool economically available to the buying public.

Still yet another object of the present invention is to provide a new alternator bearing depth setting tool which provides in the apparatuses and methods of the prior art some of the advantages thereof, while simultaneously overcoming some of the disadvantages normally associated therewith.

Still another object of the present invention is to provide a new alternator bearing depth setting tool for unbinding a bearing in a rebuilt alternator so that the bearing will spin freely in the alternator.

Yet another object of the present invention is to provide a new alternator bearing depth setting tool which includes an elongate body having opposite proximal and distal ends. The proximal end of the body has an inner well therein with an annular shoulder therearound adjacent the proximal end of the body to define an annular outer well.

Still yet another object of the present invention is to provide a new alternator bearing depth setting tool that provides a quick and easy means for unbinding a bearing of a rebuilt alternator.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
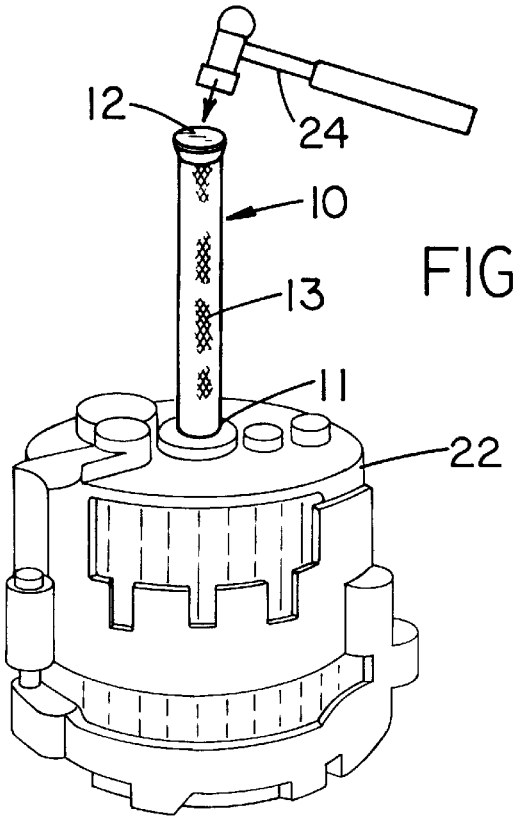
FIG. 1 is a schematic perspective view of a new alternator bearing depth setting tool in use according to the present invention.
Figure 2:
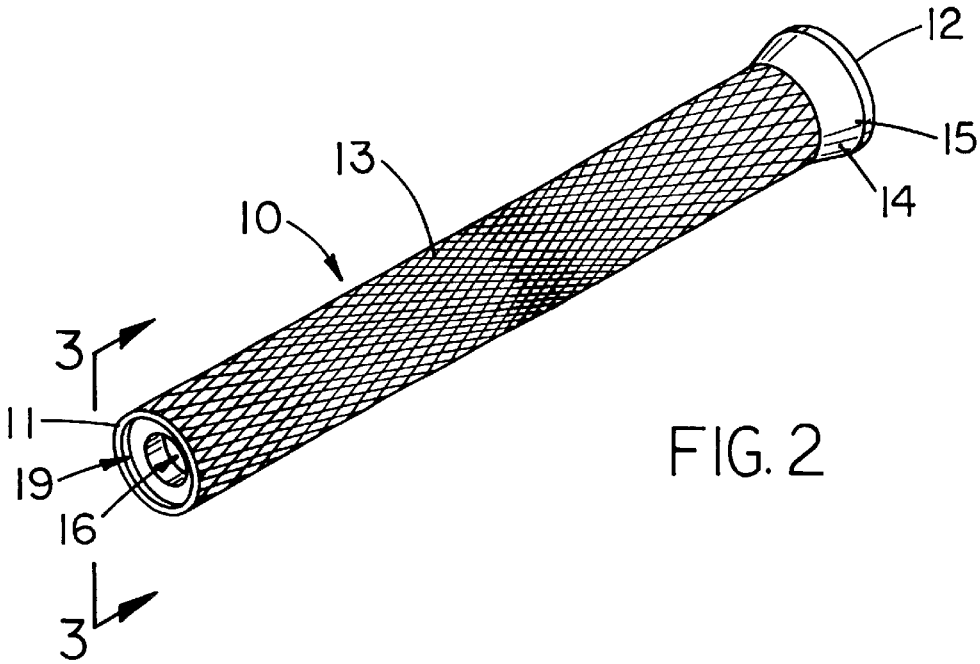
FIG. 2 is a schematic perspective view of the present invention.
Figure 3:
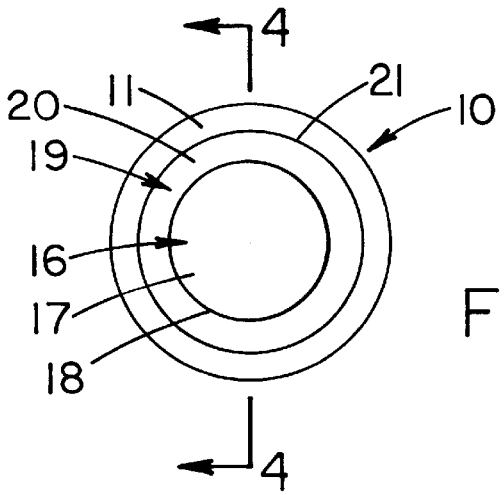
FIG. 3 is a schematic end view of the present invention taken from the vantage of line 3—3 of FIG. 2.

With reference now to the drawings, and in particular to FIGS. 1 through 4 thereof, a new alternator bearing depth setting tool embodying the principles and concepts of the present invention will be described.

As best illustrated in FIGS. 1 through 4, the alternator bearing depth setting tool generally comprises an elongate body having opposite proximal and distal ends. The proximal end of the body has an inner well therein with an annular shoulder therearound adjacent the proximal end of the body to define an annular outer well.

Specifically, the tool includes an elongate body 10 having has opposite proximal and distal ends 11, 12, and a longitudinal axis extending between the proximal and distal ends of the body. The proximal and distal ends of the body may lie in substantially parallel planes substantially perpendicular to the longitudinal axis of the body. The body may also have a knurled outer surface 13 for frictionally enhancing contact with the hand of a user grasping the body to help reduce the chance that the user's grip will slip from the body.

The body may comprises a metal material. In one such embodiment, the body may be solid and comprise a steel material. The body may also be generally cylindrical so that the body has a generally circular transverse cross section perpendicular to the longitudinal axis of the body, and the knurled outer surface of body is generally circular.

The body may have a generally frusta-conical shaped flared portion 14 at the distal end of the body for providing a larger diameter distal end for helping a user accurately strike the distal end of the body with a hammer. The flared portion may be substantially coaxial with the longitudinal axis of the body and taper in a direction from the distal end towards the proximal end of the body.

The flared portion of the body may also have a resiliently deformable outer coating 15 thereon substantially covering the flared portion. The outer coating may comprise, for example, a resiliently deformable plastic or rubber material. In use, the outer coating provides a cushion for reducing the shock and damage to the body from a hammer striking the distal end of the body.

The proximal end of the body has an inner well 16 therein. The inner well may be generally cylindrical and substantially coaxial with the longitudinal axis of the body. The inner well comprises a generally circular back wall 17 spaced apart from the proximal end of the body and a generally cylindrical perimeter side wall 18 extending from the back wall of the inner well towards the proximal end of the body. The back wall of the inner well may be concentric with the proximal end of the body and lie in a plane substantially parallel to the proximal end of the body and substantially perpendicular to the longitudinal axis of the body.

The perimeter side wall of the inner well has an annular shoulder therearound adjacent the proximal end of the body to define an annular outer well 19. The outer well comprises an annular rear wall 20 and a generally cylindrical perimeter wall 21 extending between the rear wall of the outer well and the proximal end of the body. The rear wall of the outer well may lie in a plane substantially parallel to the proximal end of the body and substantially perpendicular to the longitudinal axis of the body. The rear wall of the outer well is spaced apart from the proximal end of the body and located between the proximal end of the body and the back wall of the inner well.

The inner well has a depth defined between the proximal end of the body and the back wall of the inner well. Similarly, the outer well has a depth defined between the proximal end of the body and the rear wall of the outer well. The depth of the inner body is greater than the depth of the outer well.

In one illustrative embodiment, the depth of the inner well may be about 3/16 inch, and the depth of the outer well may be about 1/16 inch. In such an illustrative embodiment, the inner well and the outer well each have outer diameters defined perpendicular to the longitudinal axis of the body with the outer diameter of the inner well being about 3/8 inch and the outer diameter of the outer well being about 11/16 inch. The body may have an outer diameter defined at the proximal end of the body of about 3/4 inch in such an embodiment.

Figure 4:
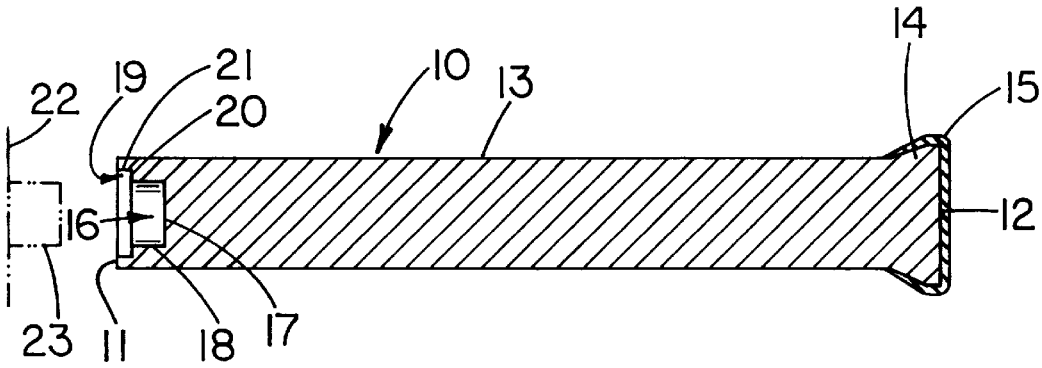
FIG. 4 is a schematic cross sectional view of the present invention taken from line 4—4 of FIG. 3.

In use, the tool is used for setting the depth of a bearing in a rebuilt alternator to unbind the bearing to permit spinning of the beating in the alternator. The alternator has a bearing rotatably mounted in an outer housing 22 of the alternator. The bearing has an extent 23 outwardly extending from the outer housing of the alternator. As illustrated in FIGS. 1 and 4, the extent of the bearing is inserted into the inner well such that the body is coaxially aligned with the extent. The distal end of the body may then be struck with a hammer 24 (using by simple tapping of the hammer on the distal end) until the extent is driven into the outer housing of the alternator to a point where the bearing is free to rotate in the outer housing of the alternator.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A tool for setting the depth of a bearing in a rebuilt alternator to unbind the bearing to permit spinning of the bearing in the alternator, comprising:

an elongate body having a knurled outer surface and opposite proximal and distal ends, and a longitudinal axis extending between said proximal and distal ends of said body, said proximal and distal ends lying in substantially parallel planes substantially perpendicular to said longitudinal axis of said body and said distal end defining a frusta-conical shaped flared portion;

said proximal end of said body having an inner well therein; and said inner well having an annular shoulder therearound adjacent said proximal end of said body to define an annular outer well.

2. The tool of claim 1, wherein said flared portion is substantially coaxial with said longitudinal axis of said body and tapering in a direction from said distal end towards said proximal end of said body.

3. The tool of claim 2, wherein said flared portion of said body has a resiliently deformable outer coating thereon substantially covering said flared portion.

4. The tool of claim 1, wherein said inner well comprising a back wall spaced apart from said proximal end of said body and a perimeter side wall extending from said back wall of said inner well towards said proximal end of said body, wherein said outer well has an annular rear wall and a perimeter wall extending between said rear wall of said outer well and said proximal end of said body.

5. The tool of claim 4, wherein said back wall of said inner well is concentric with said proximal end of said body and lies in a plane substantially parallel to said proximal end of said body and substantially perpendicular to said longitudinal axis of said body.

6. The tool of claim 4, wherein said rear wall of said outer well lies in a plane substantially parallel to said proximal end of said body and substantially perpendicular to said longitudinal axis of said body.

7. A tool for setting the depth of a bearing in a rebuilt alternator to unbind the bearing to permit spinning of the beating in the alternator, comprising:

an elongate body having opposite proximal and distal ends, and a longitudinal axis extending between said proximal and distal ends of said body;

said proximal and distal ends of said body lying in substantially parallel planes substantially perpendicular to said longitudinal axis of said body;

said body having a knurled outer surface;

said body having a generally frusta-conical shaped flared portion at said distal end of said body;

said flared portion being substantially coaxial with said longitudinal axis of said body and tapering in a direction from said distal end towards said proximal end of said body;

said flared portion of said body having a resiliently deformable outer coating thereon substantially covering said flared portion;

said proximal end of said body having an inner well therein;

said inner well being generally cylindrical and substantially coaxial with said longitudinal axis of said body;

said inner well comprising a generally circular back wall spaced apart from said proximal end of said body and a generally cylindrical perimeter side wall extending from said back wall of said inner well towards said proximal end of said body;

said back wall of said inner well being concentric with said proximal end of said body and lying in a plane substantially parallel to said proximal end of said body and substantially perpendicular to said longitudinal axis of said body;

said perimeter side wall of said inner well having an annular shoulder therearound adjacent said proximal end of said body to define an annular outer well;

said outer well having an annular rear wall and a generally cylindrical perimeter wall extending between said rear wall of said outer well and said proximal end of said body;

said rear wall of said outer well lying in a plane substantially parallel to said proximal end of said body and substantially perpendicular to said longitudinal axis of said body;

said rear wall of said outer well being spaced apart from said proximal end of said body and located between said proximal end of said body and said back wall of said inner well;

said inner well having a depth defined between said proximal end of said body and said back wall of said inner well;

said outer well having a depth defined between said proximal end of said body and said rear wall of said outer well; and said depth of said inner body being greater than said depth of said outer well.

8. The tool of claim 3, wherein said coating is selected from the group of materials consisting of rubber and plastic.

9. The tool of claim 1, wherein said inner well has a greater depth than said outer well.

* * * * *